US005775610A

United States Patent [19]

Kudrus

[11] Patent Number: 5,775,610

[45] Date of Patent: Jul. 7, 1998

[54] METHOD AND APPARATUS OF CONTROLLING ROTARY DRIVE WINDING MACHINE

[75] Inventor: Heiner Kudrus, Barmstedt, Germany

[73] Assignee: Neumag-Neumuenstersche Maschinen und Anlegenbau GmbH, Barmstedt, Germany

[21] Appl. No.: 765,599

[22] PCT Filed: Jul. 3, 1995

[86] PCT No.: PCT/EP95/02553

§ 371 Date: Dec. 30, 1996

§ 102(e) Date: Dec. 30, 1996

[87] PCT Pub. No.: WO96/01222

PCT Pub. Date: Jan. 18, 1996

[30] Foreign Application Priority Data

Jul. 5, 1994 [DE] Germany ..... 44 23 491.0

[51] Int. Cl.[6] ..... B65H 67/044; B65H 54/02

[52] U.S. Cl. ..... 242/18 A; 242/18 DD; 242/35.5 T

[58] Field of Search ..... 242/18 A, 18 DD, 242/36, 35.5 T

*Primary Examiner*—Michael Mansen
*Attorney, Agent, or Firm*—Michael J. Striker

[57] ABSTRACT

For controlling a rotary drive of a turntable which supports at least one bobbin spindle of a bobbin winding machine, a diameter of the bobbin package is calculated by forming a quotient from a product of a speed of rotation of a contact roller and a diameter of the contact roller in respect to a speed of rotation of the bobbin spindle which supports the bobbin package, the angular position of the bobbin spindle supporting the bobbin package on its circle of rotation is determined, in which the circumference of the bobbin package is in circumferential contact with the contact roller, from the calculated diameter of the bobbin package, and the rotary drive of the turntable is controlled so that the bobbin spindle supporting the bobbin package assumes the calculated angular position on its circle of rotation.

14 Claims, 12 Drawing Sheets

METHOD AND APPARATUS OF CONTROLLING ROTARY DRIVE WINDING MACHINE

BACKGROUND OF THE INVENTION

The invention relates to a method for controlling the rotary drive of a turntable, which supports at least one bobbin spindle, of a bobbin winding machine for a continuously arriving thread, which furthermore is provided with a jig motion device and with a contact roller disposed upstream of the turntable in the thread path, wherein by means of controlling the rotary drive of the turntable the contact roller is maintained in continuous circumferential contact with the bobbin package, which increases in diameter in the course of the bobbin travel and is supported by a single bobbin spindle or one of the two bobbin spindles.

EP 0 374 536 B1 describes such a method for controlling the rotary drive of a bobbin winding machine, wherein the lift of the contact roller, which is seated so that it is slightly movable, is interrogated by means of a sensor, and the rotary drive is controlled in such a way that a circumferential contact between the contact roller and the bobbin package is assured.

The method known from the cited reference is represented as a closed control circuit. Such a closed control circuit has a tendency to fluctuate, particularly under the influence of disturbances. Disturbances are, for example, vibrations of the bobbin spindle, non-circular bobbin packages and bobbin packages with surface symptoms, fluctuations in the pressure force of the contact roller, and similar ones. It is not possible to achieve a dependable operation and a good bobbin structure with the bobbin winding machine having such a control circuit.

SUMMARY OF THE INVENTION

The invention is based on the object of producing a method for controlling the rotary drive of a bobbin winding machine, which operates dependably and in a simple manner and does not tend to fluctuate.

This object is attained in accordance with the invention by calculating the respective diameter of the bobbin package by means of forming the quotient from the product of the speed of rotation (rpm) of the contact roller and the diameter of the contact roller in respect to the speed of rotation (rpm) of the bobbin spindle supporting the bobbin package, determining the angular position of the bobbin spindle supporting the bobbin package on its circle of rotation, in which the circumference of the bobbin package is in circumferential contact with the contact roller, from the calculated respective diameter of the bobbin package, and controlling the rotary drive of the turntable in such a way that the bobbin spindle supporting the bobbin package assumes the calculated angular position on its circle of rotation.

Although the speed of rotation of the contact roller is mostly constant and is therefore assumed to be a constant when calculating the respective diameter of the bobbin package, a preferred exemplary embodiment is distinguished in that the respective speed of rotation of the contact roller is detected by interrogating an appropriate sensor.

The speed of rotation of the bobbin spindle is also preferably determined by interrogating a sensor which detects it, however, when using a synchronous motor for driving the bobbin spindle it is also possible to directly use the signal triggering the synchronous motor. A preferred exemplary embodiment is distinguished in that the respective angular position of the bobbin spindle supporting the bobbin package on its circle of rotation, in which the circumference of the bobbin package is in circumferential contact with the contact roller, is read out from a table in which the angle/diameter relationship is stored. However, alternatively it is possible to perform an exact calculation by means of the geometric relationship.

In order to achieve a contact pressure of the contact roller against the bobbin package which is varied to correspond to the respective diameter of the bobbin package, it is further proposed to maintain the contact roller in a loaded rocker, wherein the load acting on the rocker, which determines the contact pressure of the contact roller against the bobbin package, is a function of the angular position of the bobbin spindle and thus of the respective diameter of the bobbin package seated on the bobbin spindle. In this case it is preferred that the force acting on the rocker is a function of its angular position and that the angular position of the bobbin spindle is set in accordance with the respective diameter of the bobbin package in such a way, that the contact pressure of the contact roller against the bobbin package assumes a predetermined value.

The invention will be explained below by means of drawing figures.

DESCRIPTION OF PREFERRED EMBODIMENTS

Figure 1:
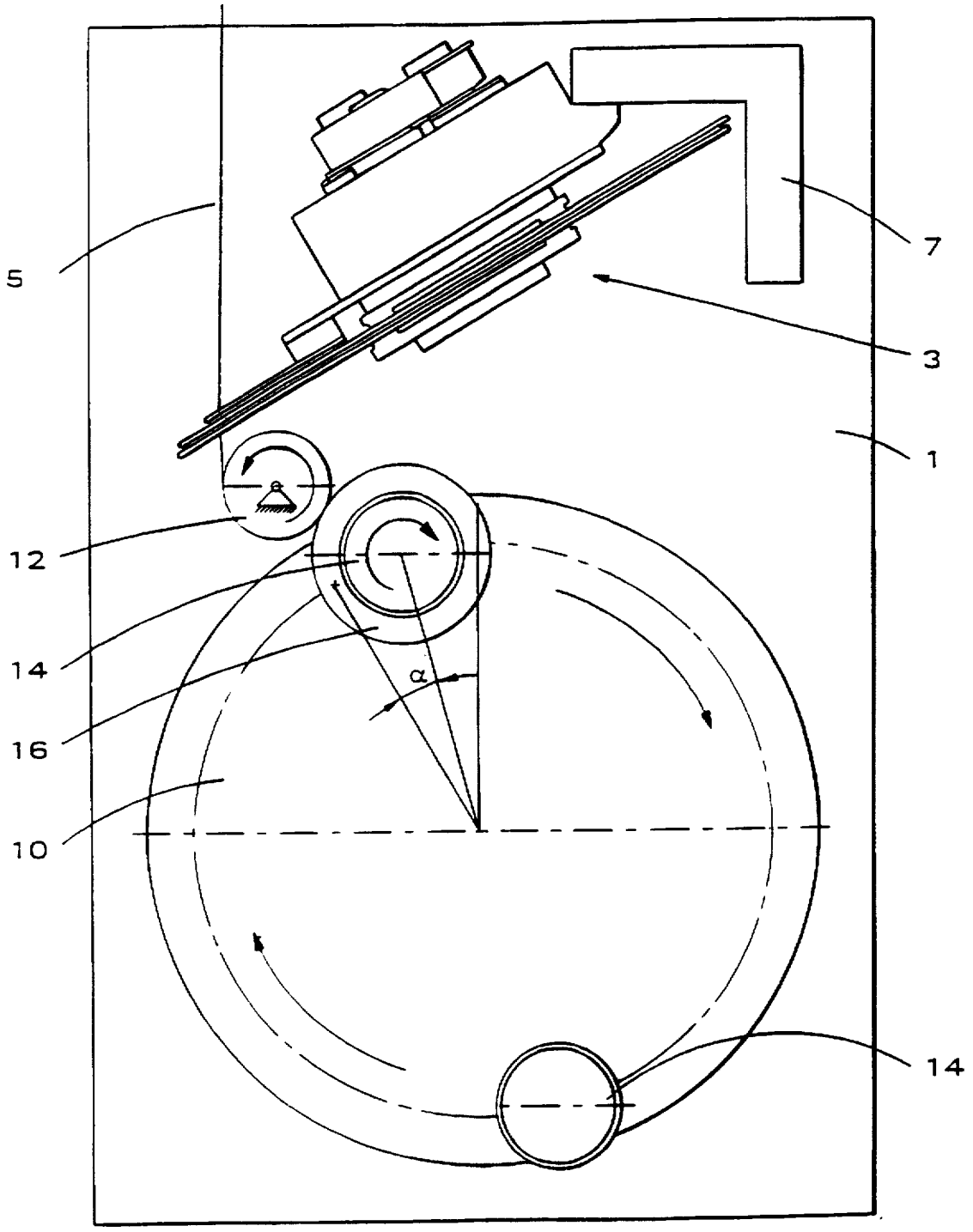
FIG. 1, the schematic structure of a bobbin winding machine.

The bobbin winding machine represented in FIG. 1 has a turntable 10, which supports two bobbin spindles 14. A contact roller 12, located upstream in the thread path and rotatable around is own axis, is fastened above the turntable 10. The contact roller 12 is in circumferential contact with the bobbin package 16 being formed on the respectively driven bobbin spindle 14. A jig motion device 3 fastened above the contact roller 12 on a support arm 7 places the thread 5 perpendicularly in respect to the rotating movement of the rotating bobbin spindle 14. A housing 1 of the bobbin winding machine receives the support arm 7, the contact roller 12 and the turntable 10. In the exemplary embodiments of the invention represented in FIGS. 1 and 2 the contact roller 12 is fixed in place, i.e. not movable radially.

A set-point adjuster 21, which presets the set speed of rotation of the contact roller 12, controls via a frequency converter 23 a first motor 25, which drives the contact roller 12. The set-point value signal of the set-point adjuster 21 is passed on to a computer 27, which receives a signal corresponding to the actual speed of rotation of the bobbin spindle 14 as a further input signal via a sensor 29. The computer 27 outputs an address signal to a table 31, from which the read-out value is entered into a control 33 which triggers the motor 35 driving the turntable 10.

Figure 2:
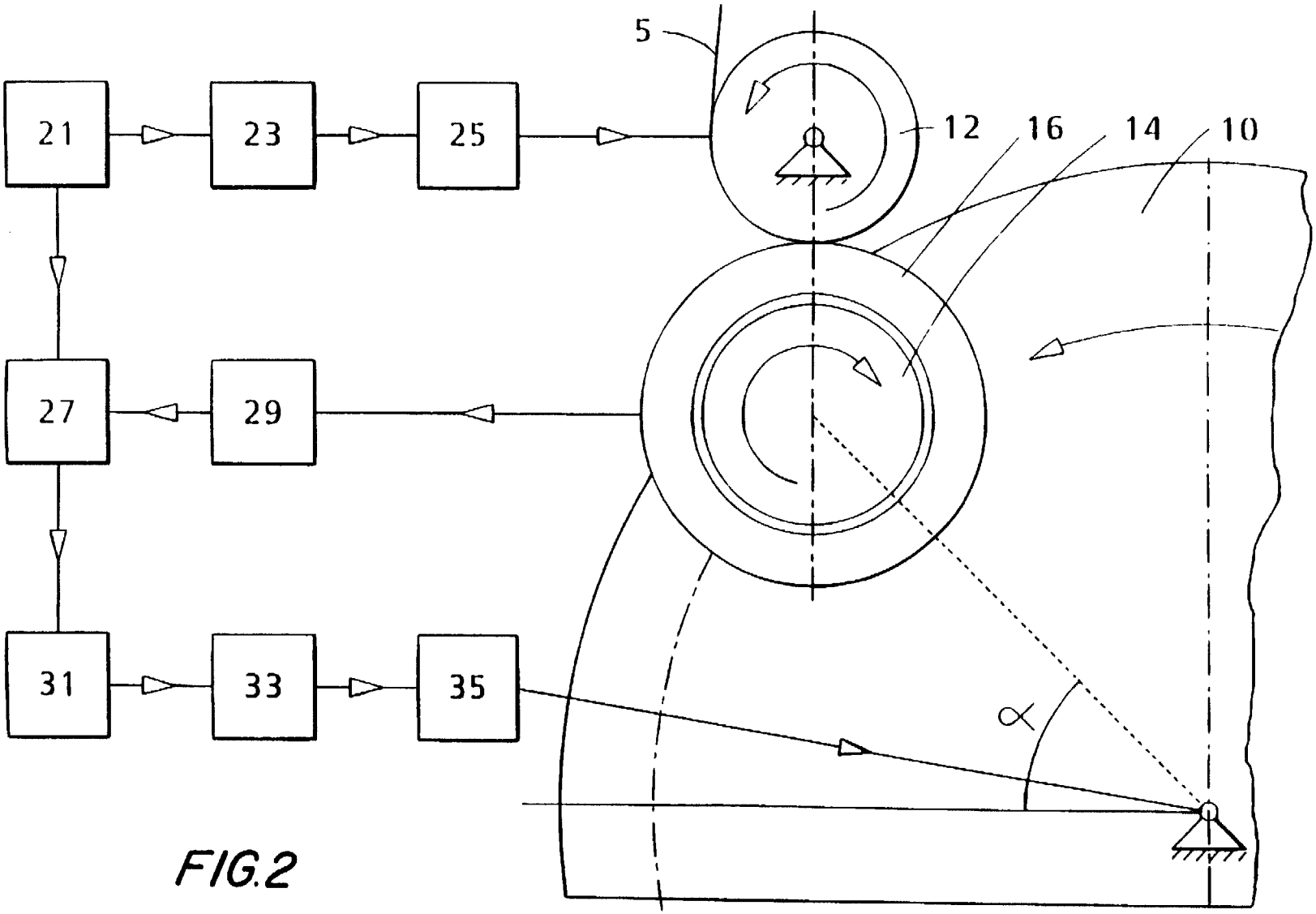
FIG. 2, a schematic representation of the method in accordance with the invention in its basic form for another bobbin winding machine.

To assure in connection with the fixed seating of the contact roller 12 that the latter is always in circumferential contact with the bobbin package, which increases in circumference during the course of the bobbin travel, the turntable 10 in FIG. 1 is turned clockwise, in FIG. 2 counterclockwise. To this end the control of the rotary drive of the turntable 10 is performed in such a way, that the speed of rotation nT of the contact roller and the speed of rotation nS of the bobbin spindle 14 are continuously determined. Since because of the contact the product of the diameter DS and the speed of rotation nS of the bobbin spindle must always be equal to the product of the speed of rotation nT of the contact roller and the diameter d of the contact roller, the following applies:

$$DS*nS=nT*d,$$

wherein, following resolution, the result is:

$$DS=(nT*d)/nS.$$

The angle α is calculated from the respective diameter DS of the bobbin package determined in this manner, at which the contact of the contact roller 12 on the circumference of the bobbin package 16 is assured. In this case it is possible in connection with the exemplary embodiment of FIG. 1 to perform the calculation by means of the geometric relationship to be found in FIG. 11, however, this is preferably performed—as represented in FIG. 2—by means of the table 31, in which the respective angular positions of the bobbin spindle 14 as a function of the respective diameter of the bobbin package 16 have been entered.

It is also possible to trigger the drive of the turntable 10 in such a way that in the course of the bobbin travel it is respectively further turned by a fixed angular value. In this case such further turning of the turntable 10 always takes place when the respective diameter of the bobbin package 16 has increased by an amount which requires such further turning of the turntable in order to maintain the desired circumferential contact with the contact roller.

Figure 3B:
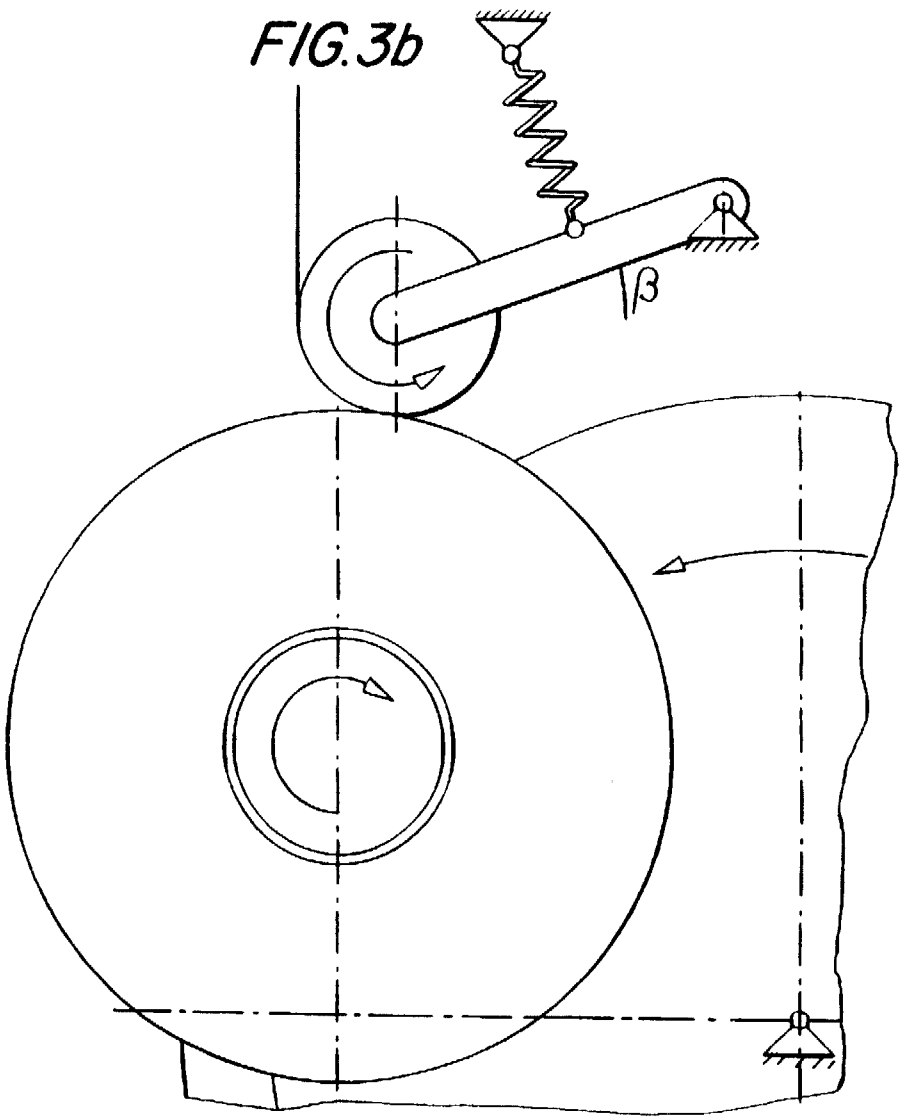
FIGS. 3*a* and FIG. 3*b*, schematic representations of further the suggestions.
Figure 3A:
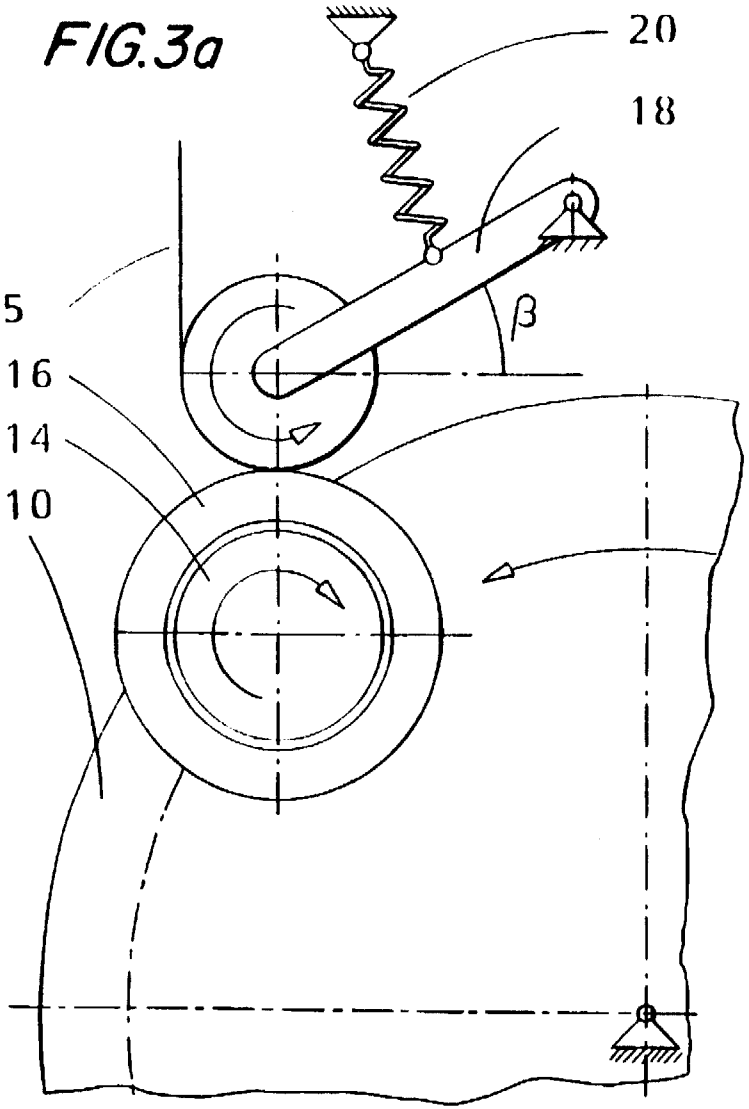

As represented in FIGS. 3*a* and 3*b*, the contact roller 12 can also be supported in a loaded rocker 18, wherein the load of the rocker 18 determines the contact pressure of the contact roller against the bobbin package 16. With an embodiment in this way the load acting on the rocker 18—possibly by the provision of a spring 20 acting on the rocker, or by the use of a pneumatically operated cylinder—can be adjusted as a function of the respective diameter of the bobbin package 16 seated on the bobbin spindle 14.

In connection with an exemplary embodiment of a movable seating of the contact roller 12 in a loaded rocker 18, the position of the contact roller 12 is also not detected and is therefore not used for controlling the angular position α of the bobbin spindle 14 supporting the bobbin package 16.

FIGS. 3*a* and 3*b* show the spring 20 which is stressed differently because of the displacement of the contact roller 12. The contact line between the contact roller 12 and the bobbin package 16, which wanders in the course of the bobbin travel, is clearly visible. To set a predetermined contact pressure force of the contact roller 12 against the bobbin package 16, the angular position of the bobbin spindle 14 is adjusted as a function of the respective diameter of the bobbin package 16 in such a way, that the contact roller 12 takes up a position in which the spring 20 generates a corresponding force through the rocker 18.

Because the use of positive feedback is relinquished, control fluctuations are excluded, the effect of the assurance of a predetermined constant contact pressure, or—as in the last exemplary embodiment—one that is a function of the respective diameter of the bobbin package 16, between the contact roller 12 and the bobbin package 16 is always assured.

Figure 4:
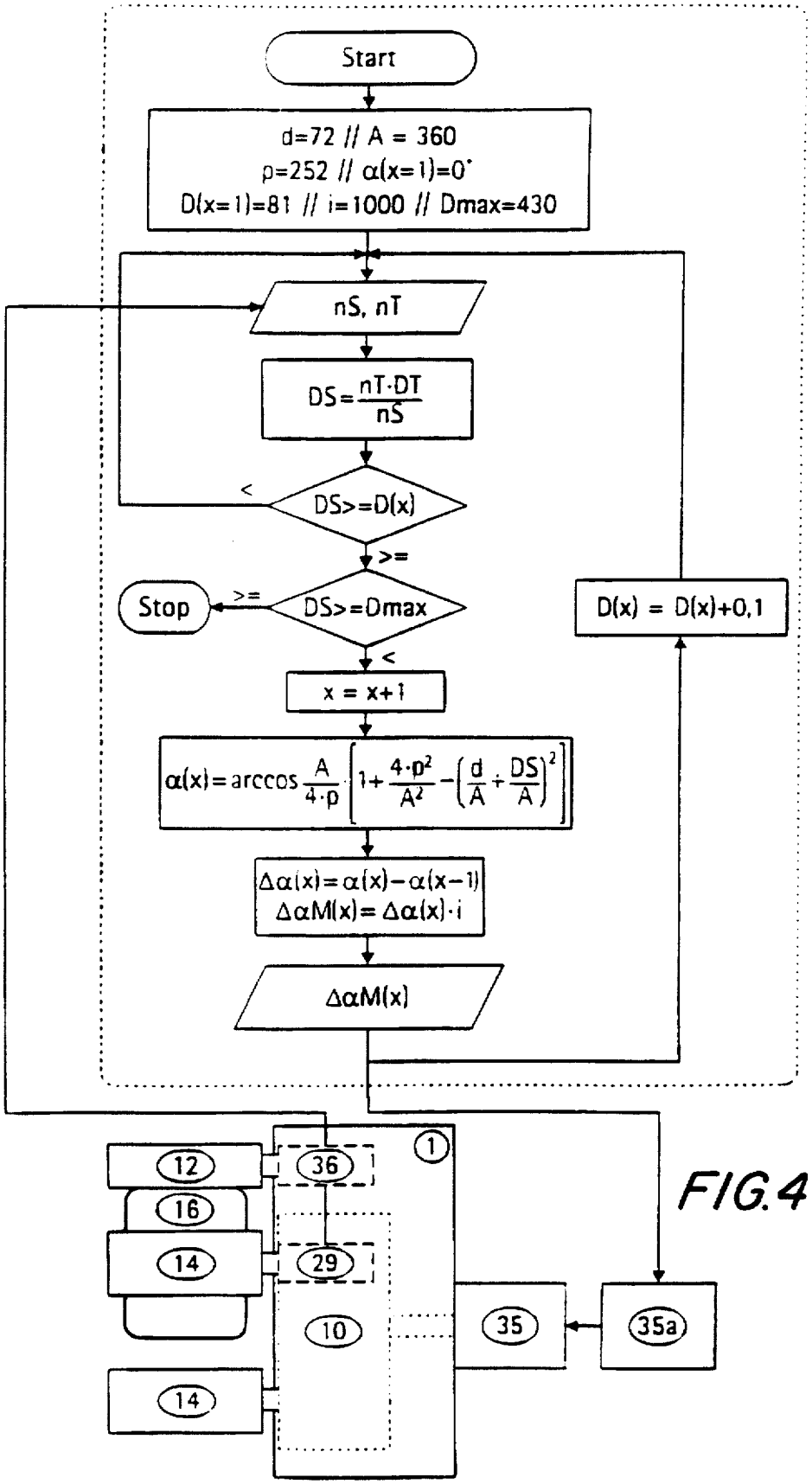
FIGS. 4 to 10 symbolically show the program flow for different exemplary embodiments.

FIG. 4 symbolically shows the control of a winding process. The motor 35 which drives the turntable 10 is a step motor in this case. For example, it performs 1,000 steps per revolution. It is provided with a gear, not represented in the drawings, which reduces the movement of the motor 35, for example at a ratio i=1:1000. Each switching step of the motor therefore causes the rotation of the turntable 10 by 0.000360.

The control operates in a clocked manner. The consecutive number of the clock cycle is identified by x. The control device is programmed in such a way that a switching process is respectively performed when the diameter DS of the bobbin package 16 has reached or surpassed a predetermined value. In the example considered in connection with FIG. 4, the predetermined diameter increases by 0.1 mm from cycle to cycle. This increment is entered into the device. Prior to the start of the winding process, the essential dimensions of the machine and the parameters of the respective winding process are also entered, namely the diameter d of the contact roller, the effective diameter A of the turntable (which is twice the distance of the axis of one bobbin spindle 14 from the axis of the turntable 10), the distance p between the axis of the turntable and the axis of the contact roller, the angle α (x=1) for the start of the winding process, the diameter D (x=1) of the bobbin, the reduction ratio i of the gear interposed between the motor 35 and the turntable 10, and the diameter Dmax of the finished bobbin.

The rpm nS of the bobbin package 16 are measured during the winding process by means of the sensor 29. The rpm nT of the contact roller 12 are also measured by means of a sensor 36. The instantaneous diameter DS of the bobbin package 16 is calculated from the two rpm and the diameter d of the contact roller 12.

It is now assumed that the diameter DS has almost reached the diameter D (x). In this case D (x) is the diameter which is associated with the cycle with the consecutive number x. The instantaneous diameter DS calculated from the measured rpm nS is compared with the predetermined diameter D (x). If D (x) has not yet been reached, the cycle is repeatedly performed. If the instantaneous diameter DS is equal to or slightly greater than D (x), a check is first performed whether the instantaneous diameter DS has already reached the predetermined final diameter Dmax of the bobbin package 16. If this is the case, the winding process is stopped and the drive of the turntable 10 is switched off. However, if the instantaneous diameter DS has not yet reached the final diameter Dmax, the consecutive number x is increased by 1. The angle α (x) associated with the instantaneous diameter DS is calculated with the aid of the formula recited in FIG. 11. Subsequently, the difference Delta α (x) between the angle α (x) and the already previously attained angle α (x−1) is determined. The difference angle Delta α (x) is multiplied by the reduction i. This results in the angle over which the motor 35 must rotate. The difference angle is transmitted to the control unit 35*a* of the motor 35, which performs the calculated change. Performance of this process is continued until the final diameter Dmax has been reached.

Figure 5:
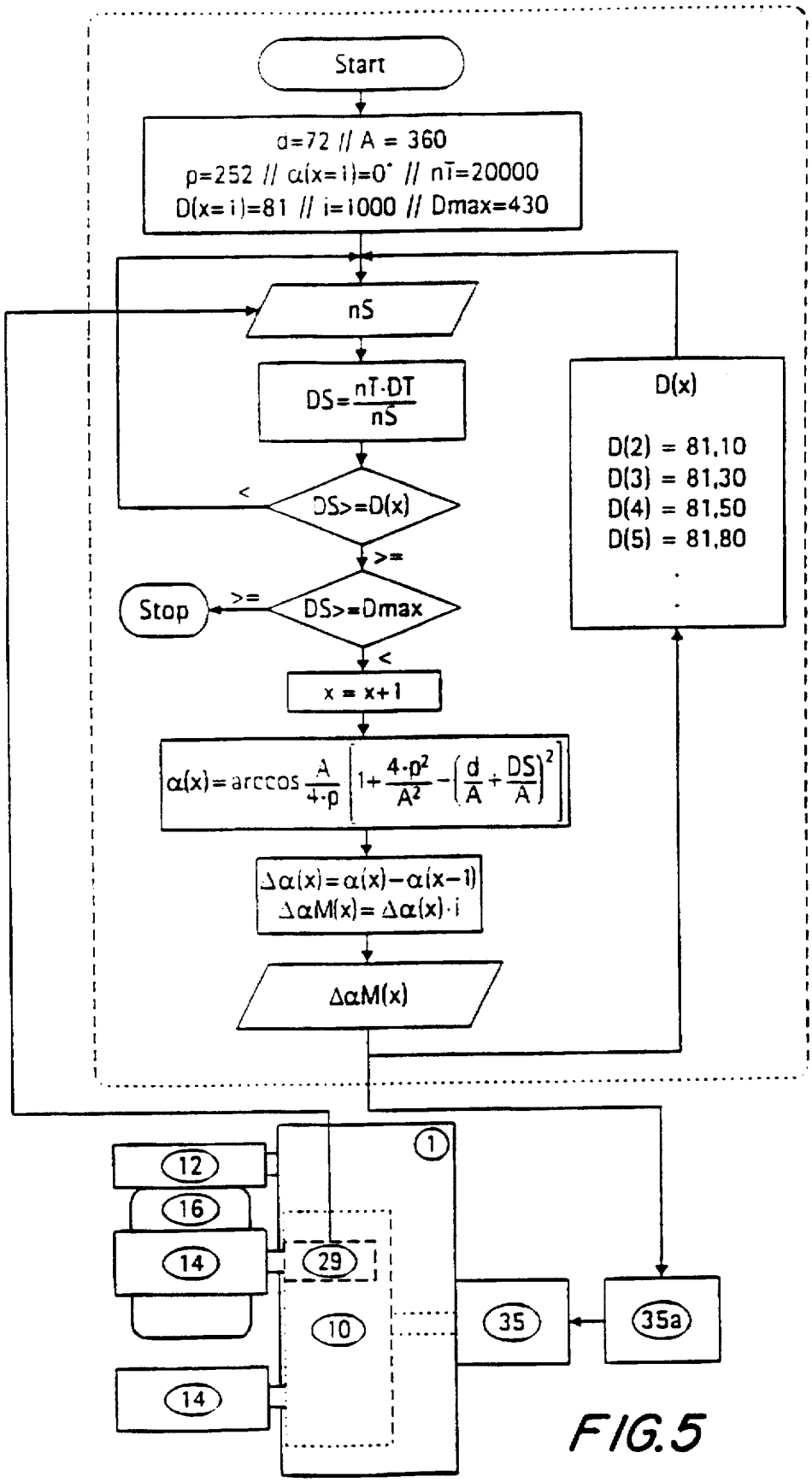

The winding process represented in FIG. 5 is characterized by two differences in comparison with the process in accordance with FIG. 4: it is assumed that the rpm nT of the contact roller 12 are constant. The constant rpm nT are additionally entered into the device. A sensor for measuring nT is not provided. The second difference is that a table is entered which individually assigns a diameter D (x) to each single cycle x. The differences between the diameters of succeeding cycles can be of different values. This can be practical, for example, if an increased time interval is necessary for exchanging a full bobbin for an empty tube.

Figure 6:
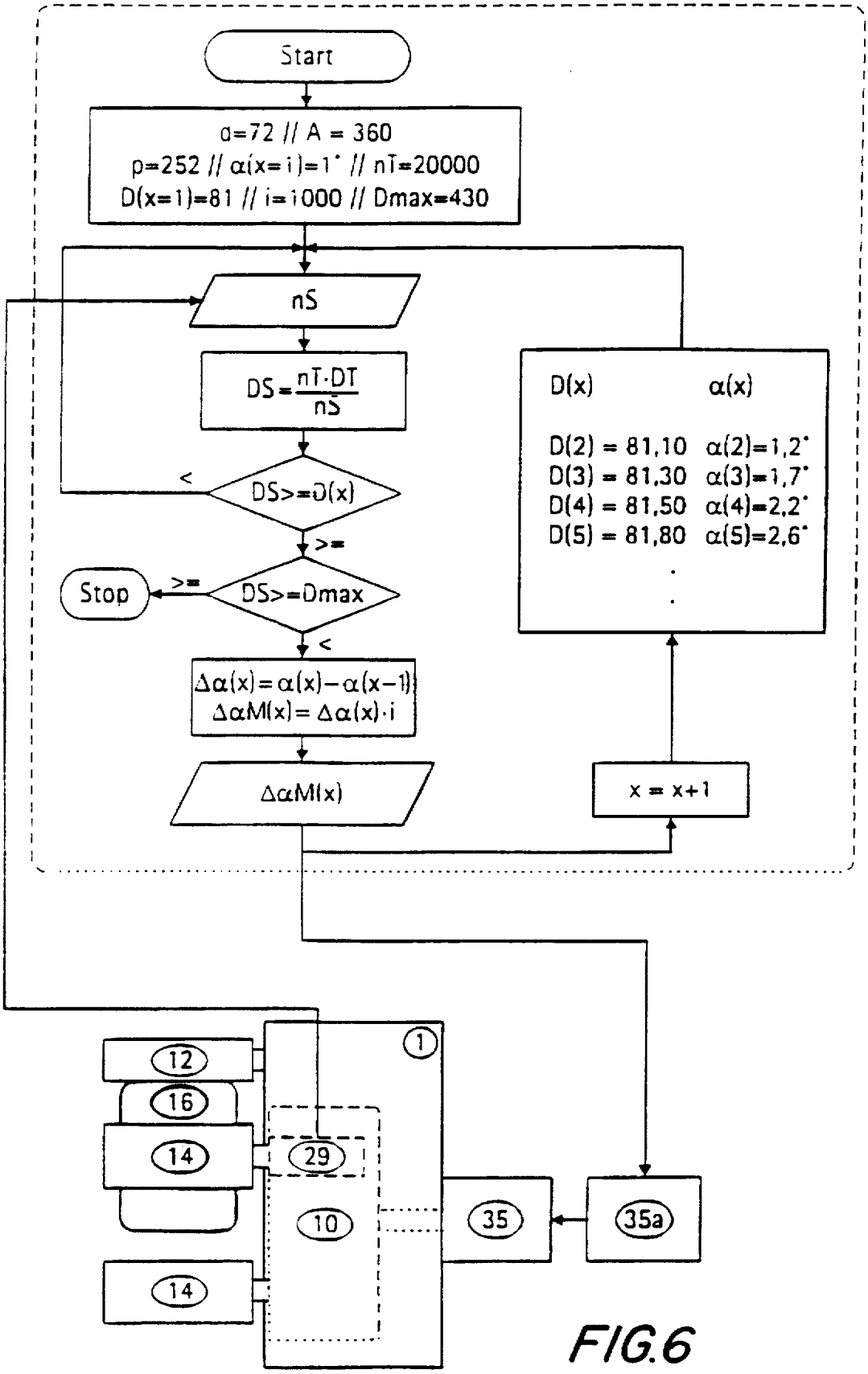

The exemplary embodiment of FIG. 6 differs from the exemplary embodiment represented in FIG. 5 in that, in addition to the diameters, the respective angles α (x) are also entered in the form of a table. This is advantageous if a control is used which cannot perform an arithmetic calculation in accordance with the formula recited in FIG. 11.

Figure 7:
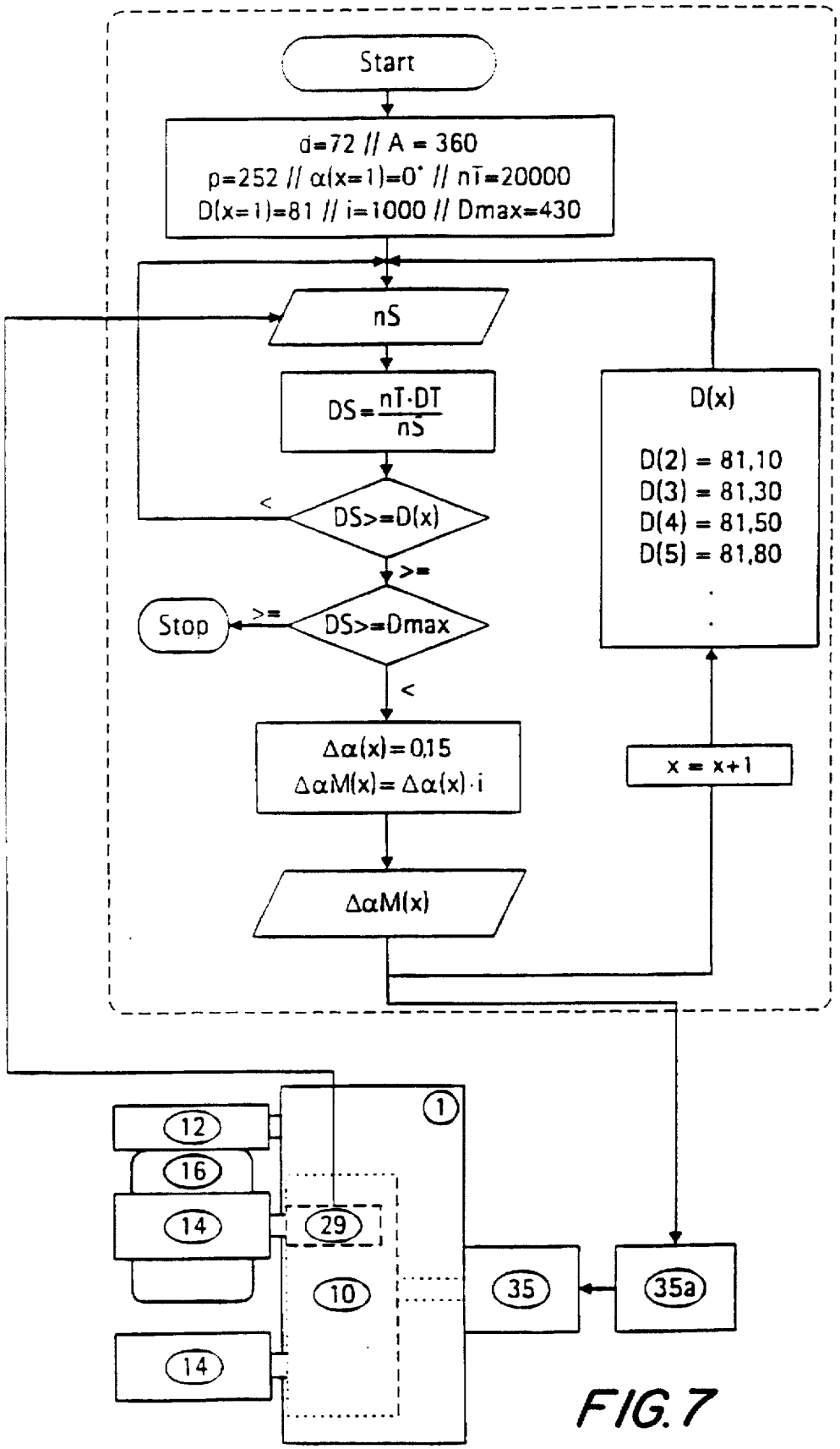

In the control in accordance with FIG. 7, the control device receives the order to change the respective angular position α from cycle to cycle by a constant difference angle. The associated diameters are calculated by means of the formula recited in FIG. 11 and are entered in the form of a table.

Figure 8:
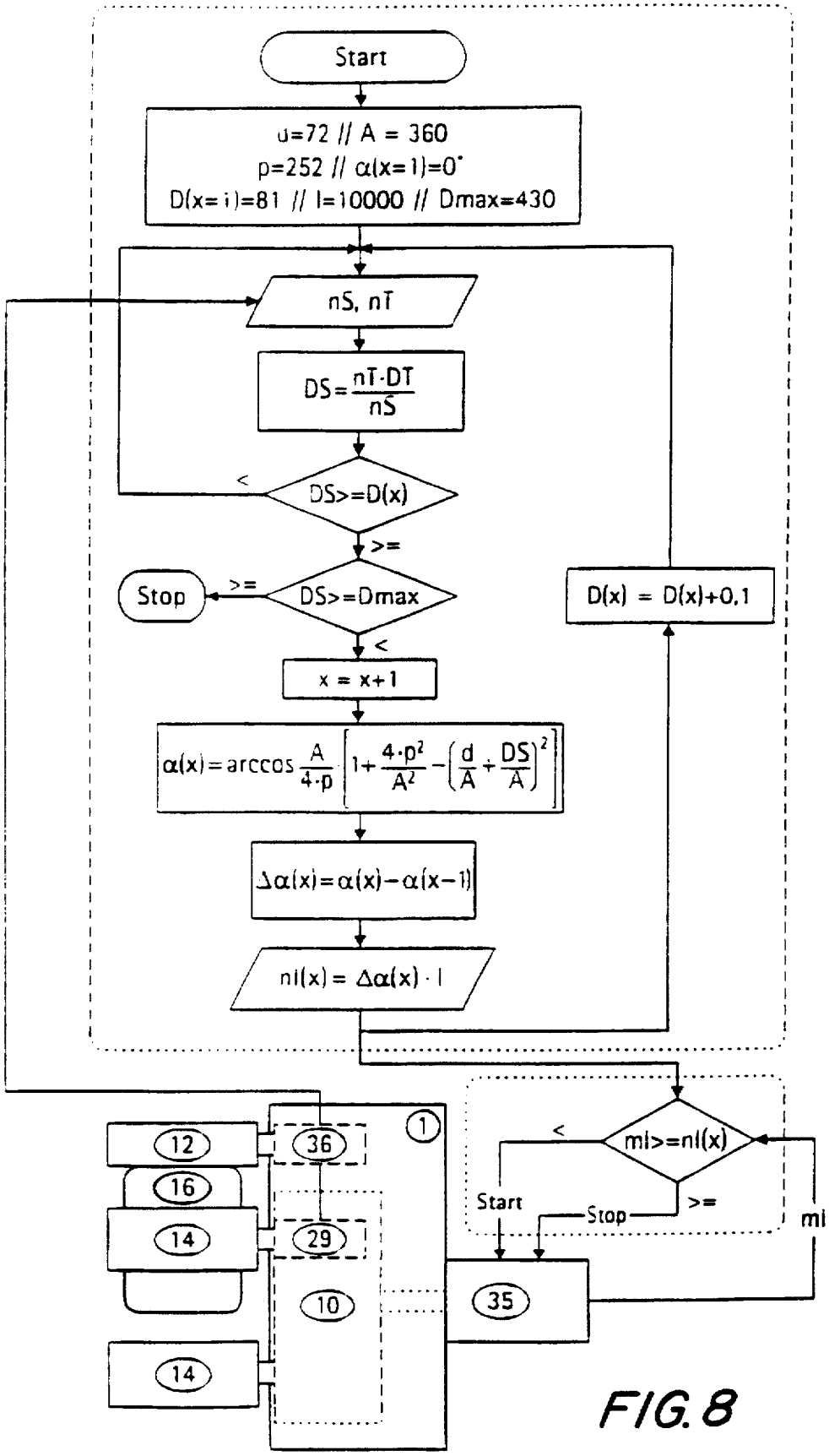

In the exemplary embodiment in accordance with FIG. 8 the motor 35, which is directly coupled with the shaft of the turntable (10) without an interposed gear, is equipped with an incremental sensor, not shown separately. The latter transmits during each revolution of the motor 35 a defined number I of pulses to a control unit, which is part of the motor (Example: 10,000 pulses per revolution).

The difference angle Delta α (x) is calculated analogously to FIG. 4. A pulse number nI (x)=Delta α (x) * I corresponds to this angle. The control device of the motor 35 compares the number of the pulses transmitted by the incremental sensor with the number of pulses determined by the computer. When this has been reached, the control device shuts the motor 35 off.

Figure 9:
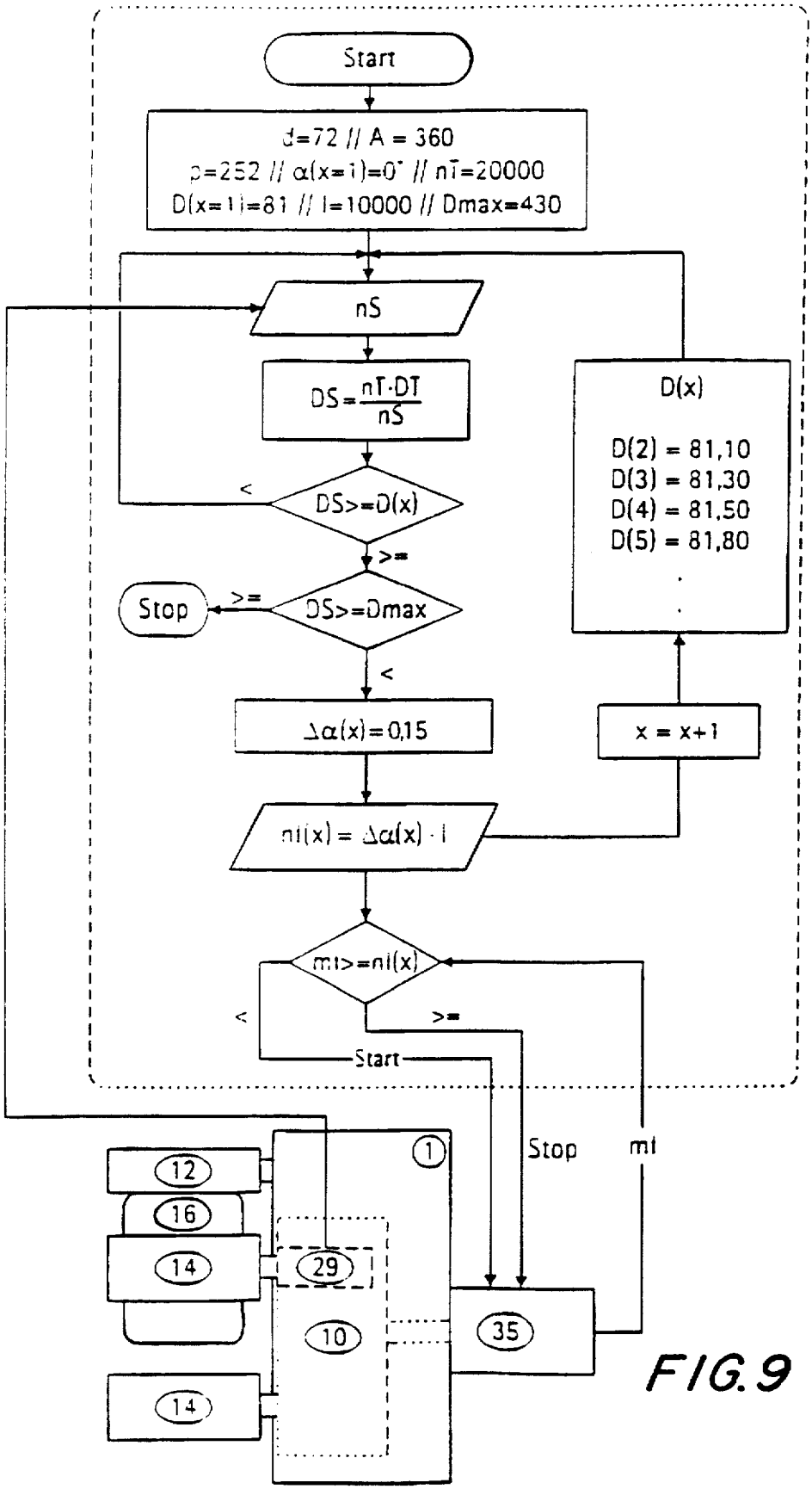

In the exemplary embodiment of FIG. 9, the control device is given the command, analogous with FIG. 7, to change the angle position α step by step by a constant difference angle. The assigned diameters are entered in the form of a table. Differing from FIG. 7, but in agreement with FIG. 8, the motor 35 is connected directly with the shaft of the turntable 10, so that the motor 35 and the turntable 10 change their angular positions always by the same amount. The comparison between the pulse number determined by the computer and the number of the pulses transmitted by the incremental sensor takes place in the computer.

Figure 10:
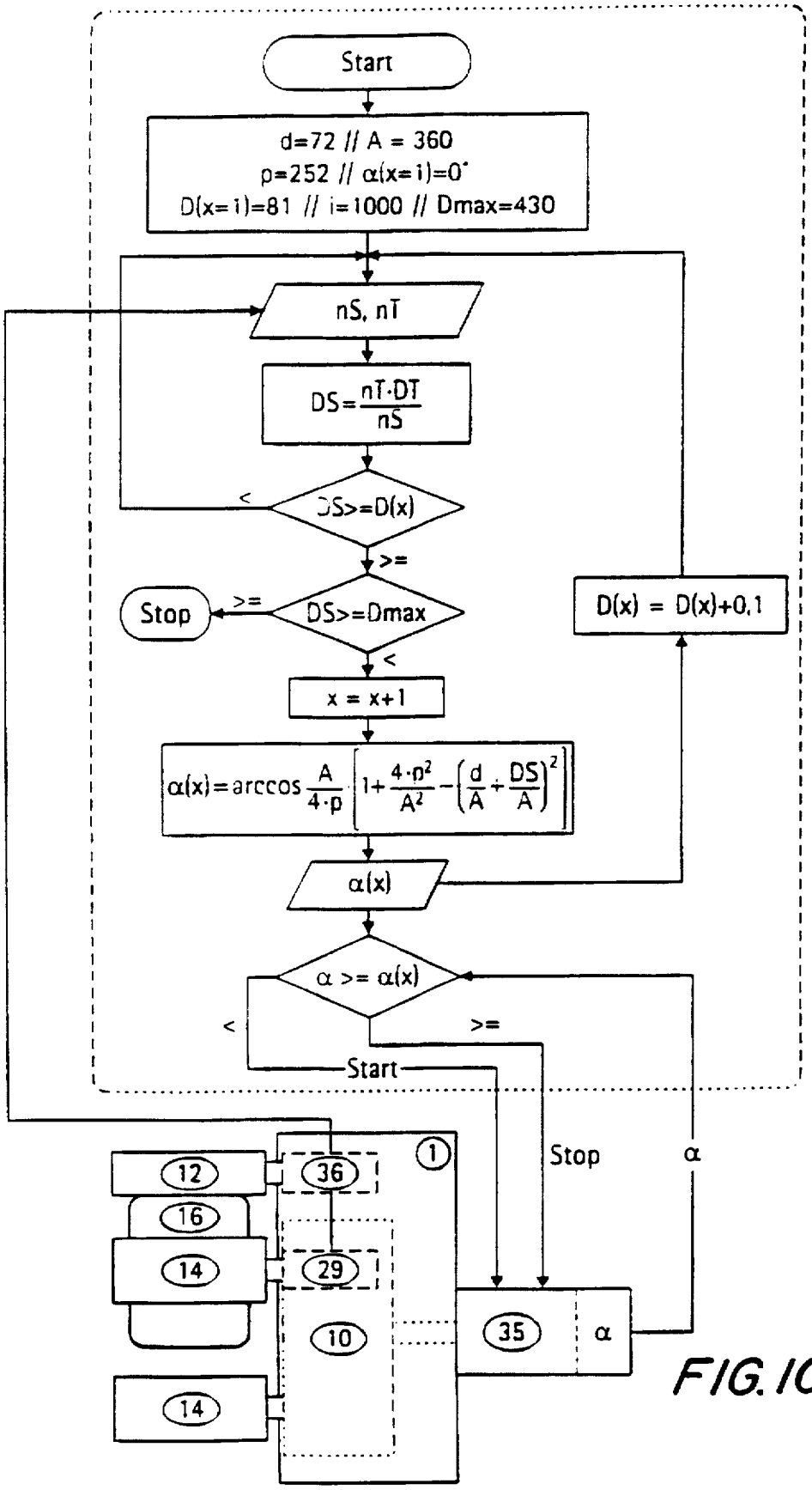

In the exemplary embodiment of FIG. 10, the motor 35 is equipped with an absolute value sensor. An absolute value has been assigned to each angular position of the motor 35 and of the turntable 10 directly coupled with it. For example, a full revolution is divided into 4,096 absolute values. The absolute value is transmitted to the computer and is compared there with the angle α (x) determined analogously to FIG. 3.

Figure 11:
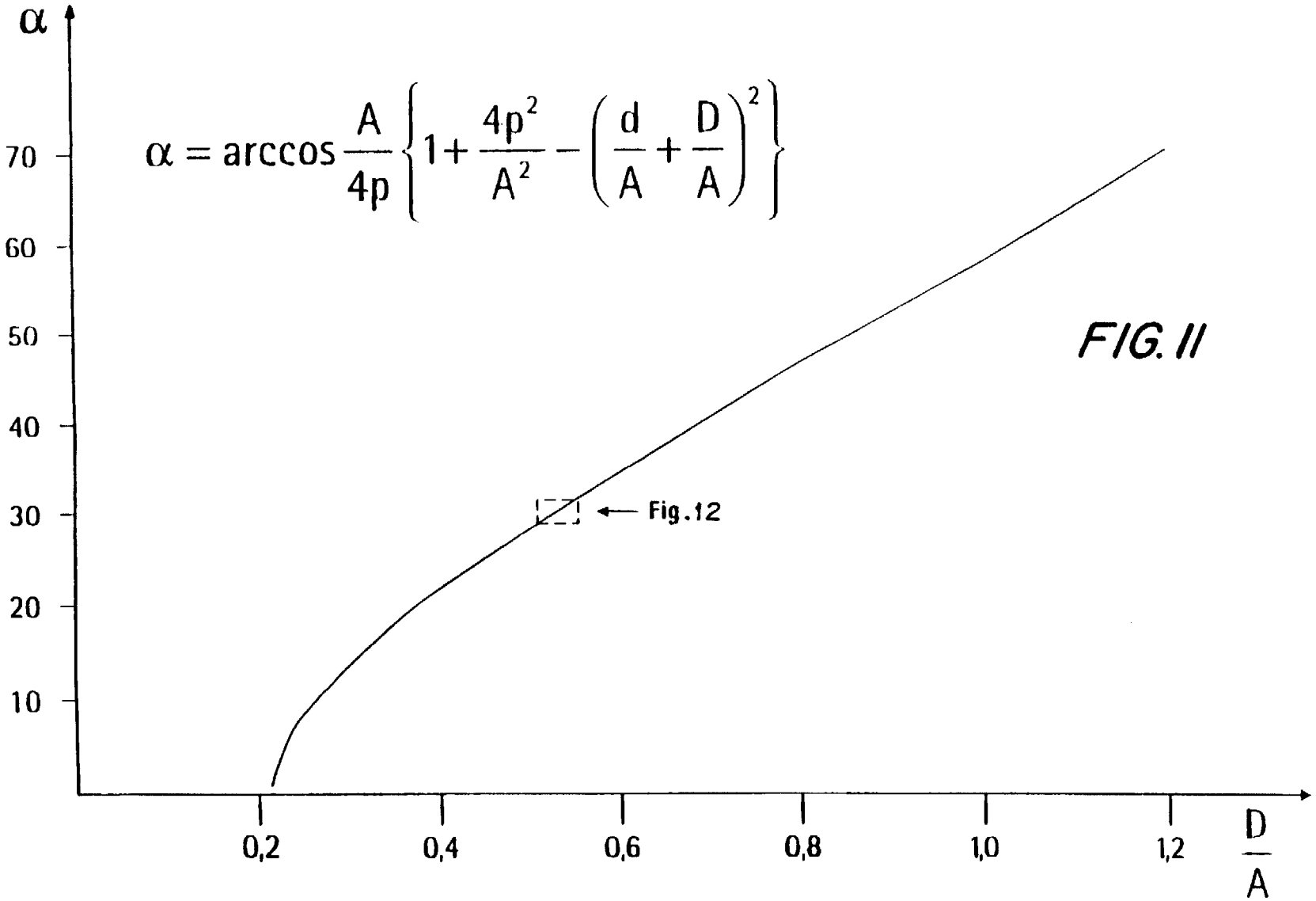
FIG. 11 shows the angular position of the turntable as a function of the diameter of the bobbin for a concrete bobbin winding machine.
Figure 12:
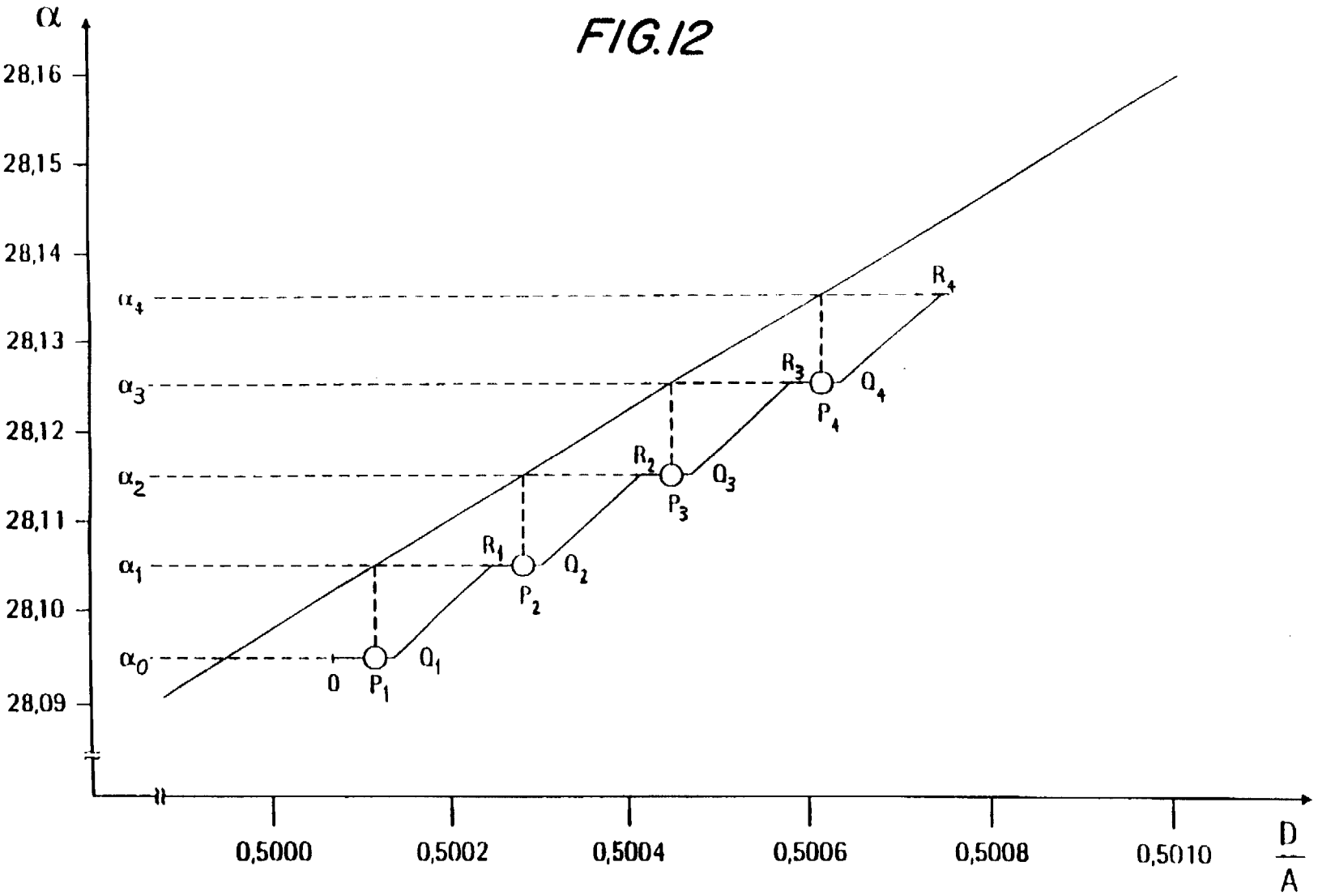
FIG. 12 shows an enlarged section of FIG. 11 as well as the actual states which are passed in a concrete winding process.

FIGS. 11 and 12 relate to a concrete example, namely the winding of a bulky carpet fiber by means of a bobbin winding machine essentially in accordance with FIG. 1. The process parameters and the dimensions of the bobbin winding machine are recited in Table 1. They conform to general practice.

The state of the system at a defined moment is characterized by the instantaneous diameter DS of the bobbin 16 and by the angle α which the turntable 10 has momentarily taken up. If this state in FIG. 11 corresponds to a point located exactly on the curve, the contact roller 12 touches the surface of the bobbin package 16 without pressure.

If the system is in a state characterized by a point located below the curve, the actual angle α is less than what the function indicates. This means that the contact roller is pressed into the bobbin. The depth of the depression in accordance with the elasticity of the bobbin package 16 is connected with the contact pressure force with which the contact roller 12 rests against the bobbin. A contact pressure force is always active during operation. It is important to keep it under control. This is achieved by keeping the indentation depth under control.

If the system were to be in a state which, in FIG. 11, lies above the curve, the angle α would be greater than recited in the formula. A gap would appear between the bobbin package 16 and the contact roller 12.

FIG. 12 shows a small section of the curve in FIG. 11, enlarged one thousand times. A zig-zag curve can be seen in FIG. 12 under the curve. It symbolizes the tracking of the turntable in accordance with the invention. The time interval during which the zig-zag curve is travelled, is located at an arbitrarily selected place in the course of the bobbin travel.

At the start of the viewed interval, the system is in a state characterized by the point O. The bobbin diameter is slightly above 18 cm and the turntable is in a position α0, i.e. slightly more than 28°. In the state O the motor of the turntable is switched off. The continuously increasing diameter of the bobbin is being monitored.

After a short period of time the system reaches a stage characterized by the point P1 in FIG. 12. The diameter associated with this point is stored in a table. As soon as the comparison of the instantaneously reached diameter with the stored diameter shows that the bobbin has reached the stored diameter, the angle α1 associated with this is read out from the curve or calculated with the aid of the formula. A conventional microprocessor control requires, for example, 0.025 s for this. In the meantime the bobbin has reached the state Q1, i.e. the diameter has increased a little, but the angle remains α0. Now the motor 35 of the turntable 10 is switched on and the angle is increased to a value α1. The increase of the angle α is approximately 0.01°. A length of time of 0.075 s is required for the angle adjustment. The state R1 is subsequently reached. Thus, the path P1, Q1, R1 was travelled in a total of 0.1 s. Since during this period of time the diameter of the bobbin package 16 has been further increased, R1 again lies below the curve. With the motor 35 shut off, i.e. with the angle α1 unchanged, winding is continued up to the point P2, whose diameter is also stored. A new cycle is then started, etc.

It is possible to read out from FIG. 12 how deep the contact roller 12 presses into the bobbin 12. The zig-zag curve represents the actually passed states. Its horizontal distance from the smooth curve is a measurement for the indentation depth of the contact roller 12 into the bobbin package 16. The indentation depth results from the horizontal distance by multiplication with A/2. In this way it is possible to read from FIG. 12, that the indentation depth fluctuates at a small amplitude around a middle value and always remains below 0.04 mm in the interval being considered. In many practical cases the changes of the contact pressure force corresponding to this are of no importance. This applies in particular to the carpet fiber which is being wound in the example being considered. Such fibers are very bulky and the bobbins wound from the fibers are relatively soft and can be easily indented.

In other cases where, for example, work is performed at lower yarn speeds and/or with lower titers, the increase of the diameter per step is even much less. It is then possible to also wind harder bobbins in accordance with the method of the invention. But it is also possible to seat the contact roller resiliently. It then can evade the growing bobbin. If the angle α is then increased, it falls back into a predetermined base position

TABLE 1

| | |
|---|---|
| Effective diameter of the turntable | A = 36 cm |
| Diameter of the contact roller | d = 7.2 cm |
| Axial distance turntable/contact roller | p = 25.2 cm |
| Yarn speed | v = 4000 m/min |
| Titer | T = 2000 dtex |
| Width of the bobbin | B = 25 cm |
| Packing density of the bobbin | pi = 0.5 kg/dm$_3$ |

What is claimed is:

1. A method of controlling a rotary drive of a turntable which supports at least one bobbin spindle supporting a bobbin package which is being wound so that the bobbin package increases in diameter in a course of the bobbin travel in a bobbin winding machine for a continuously arriving thread with a predetermined yarn path, which winding machine also has a contact roller located upstream of the turntable in the yarn path, the method of controlling comprising the steps of determining a speed of rotation of the contact roller, a diameter of the contact roller, and a speed of rotation of the bobbin spindle supporting the bobbin package; calculating a diameter of the bobbin package by forming a quotient from a product of the determined speed of rotation of the contact roller and the diameter of the contact roller in respect to the determined speed of rotation of the bobbin spindle supporting the bobbin package; determining an angular position of the bobbin spindle supporting the bobbin package on its circle of rotation, in which a circumference of the bobbin package is in circumferential contact with the contact roller, from the calculated diameter of the bobbin package; and controlling the rotary drive of the turntable so that the bobbin spindle supporting the bobbin package assumes the determined angular position on its circle of rotation, so as to maintain the contact roller in continuous circumferential contact with the bobbin package.

2. A method as defined in claim 1, wherein said determining the speed of rotation of the contact roller includes detecting the speed of rotation of the contact roller by a sensor, and interrogating the sensor.

3. A method as defined in claim 1, wherein said determining the speed of rotation of the bobbin spindle includes detecting the speed of rotation of the bobbin spindle by a sensor, and interrogating the sensor.

4. A method as defined in claim 1, and further comprising forming a table which contains data related to a relationship of an angle and a diameter of the bobbin package, and determining the angular position of the bobbin spindle by reading out the data from the table.

5. A method as defined in claim 1, and further comprising driving the turntable step by step in fixed angular amounts; and storing values of the diameter of the bobbin package during rotation of the turntable in a table.

6. A method as defined in claim 1, and further comprising maintaining the contact roller in a loaded rocker so that a load acting on the rocker and determining a contact pressure of the contact roller against the bobbin package as a function of the angular position of the bobbin spindle and of the diameter of the bobbin package seated on the bobbin spindle.

7. A method as defined in claim 6, and further comprising setting a force acting on the rocker as a function of its angular position and of the angular position of a bobbin spindle in accordance with the diameter of the bobbin package so that the contact pressure on the contact roller against the bobbin package assumes a predetermined value.

8. A bobbin winding machine for continuously arriving yarn, comprising a jig motion device; a turntable on which at least one bobbin spindle for receiving a bobbin is fastened; a motor for driving the turntable; a contact roller; and a control device which controls the motor of the turntable so that the contact roller is maintained in continuous contact with a bobbin whose diameter increases in a course of a bobbin travel, said control device including a sensor for measuring a speed of rotation of the bobbin, a computer for calculating an instantaneous diameter of the bobbin from a signal transmitted by the sensor and for determining an angular position associated with the diameter, of the turntable in accordance with a predetermined table or function corresponding to dimensions of the machine, and a control unit to which a signal formed by the computer and corresponding to angular position is transmitted for controlling the motor of the turntable.

9. A bobbin winding machine as defined in claim 8, and further comprising a sensor for measuring a speed of rotation of the contact roller.

10. A bobbin winding machine as defined in claim 8, and further comprising a rocker in which the contact roller is seated.

11. A bobbin winding machine as defined in claim 10, and further comprising means for loading the rocker and including a spring.

12. A bobbin winding machine as defined in claim 8, wherein said computer operates in a clocked manner, said motor being a step motor which is switched on in cycles predetermined by the computer and is switched off after a number of steps which are determined by the computer and transmitted to the control unit.

13. A bobbin winding machine as defined in claim 8, wherein the computer operates in a clocked manner, said motor being equipped with an incremental sensor which transmits a predetermined number of pulses per revolution, the motor being switched on in cycles predetermined by the computer and switched off when the incremental sensor has emitted a number of pulses determined by the computer.

14. A bobbin winding machine as defined in claim 8, wherein the computer operates in a clocked manner, the motor being equipped with an absolute value sensor for the angular position, the motor being switched on in cycles predetermined by the computer and switched off when the angular position reached coincides with an angular position determined by the computer.

* * * * *